US006644986B1

(12) United States Patent
Wilker, Sr.

(10) Patent No.: US 6,644,986 B1
(45) Date of Patent: Nov. 11, 2003

(54) MEDICAL EQUIPMENT POWER CORD AND PLUG

(75) Inventor: John B. Wilker, Sr., Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/527,875

(22) Filed: Mar. 17, 2000

Related U.S. Application Data

(60) Provisional application No. 60/125,173, filed on Mar. 19, 1999.

(51) Int. Cl.[7] ..... H01R 29/00

(52) U.S. Cl. ..... 439/106; 439/108; 439/623; 439/222

(58) Field of Search ..... 439/106–108, 439/623, 222, 588

(56) References Cited

U.S. PATENT DOCUMENTS

| | | | | | |
|---|---|---|---|---|---|
| 4,019,797 | A | * | 4/1977 | Praml | 439/107 |
| 4,025,139 | A | * | 5/1977 | Martucci | 439/106 |
| 4,063,793 | A | | 12/1977 | Judd | 439/588 |
| 4,079,344 | A | * | 3/1978 | Lauben et al. | 439/106 |
| 4,274,692 | A | | 6/1981 | Hoffman et al. | 439/276 |
| 5,116,232 | A | | 5/1992 | Follett | 439/107 |
| 5,256,076 | A | * | 10/1993 | Hamlin | 439/107 |

* cited by examiner

*Primary Examiner*—Hien Vu
(74) *Attorney, Agent, or Firm*—Barnes & Thornburg

(57) ABSTRACT

A redundantly ground plug having a live prong, a neutral prong, a first ground prong and a second groung prong arranged to be received in a live contact, a neutral contact, and a ground contact of a first socket and a ground contact of a second socket of a standard power supply such as a duplex receptacle or power strip is disclosed. A flexible boot extends from the plug to seal the prongs and contacts from moisture.

16 Claims, 4 Drawing Sheets

MEDICAL EQUIPMENT POWER CORD AND PLUG

This application claims the benefit of U.S. provisional application Ser. No. 60/125,173 filed Mar. 19, 1999.

BACKGROUND OF THE INVENTION

This invention relates to electrical cords and plugs and more specifically to electrical cords and plugs that provide redundant grounding of a device to which the plug is connected.

Medical equipment is often used in wet or damp environments or in the presence of fluids which increases the hazard of electrocution or electrical shock from the device. Therefore, medical equipment is typically provided with cords and plugs for receipt into a receptacle providing a path to ground.

It is common practice to provide medical equipment and other equipment with a cord including a hot or live wire, a neutral wire, and a ground wire. These cords terminate in a three-prong plug having a live prong, a neutral prong, and a ground prong electrically connected to the live wire, neutral wire, and ground wire respectively. Electrical outlets in health care facilities typically include grounded receptacles for receipt of a three-prong plug. The receptacles include conductive paths that are connected to a live line terminating at the hot bus of the electrical supply, a neutral line terminating at the neutral bus of the electrical supply, and a ground line terminating at the ground bus of the electrical supply providing a path to ground for current. The ground wire and conductive path connected to the ground line form parts of a ground circuit. Damage to any part of the ground circuit, including the plug, receptacle, or cord subjects a patient to the possibility of electrical shock from the medical device.

Ground fault interrupter circuits are available which detect electrical surges caused by failure of grounding circuitry and interrupt the currents supplied to the live wires. However, in a medical environment, interruption of electrical power to the medical equipment can have catastrophic results precluding the use of ground fault interrupter circuits with many medical devices. Therefore, the preferred method of preventing electrical shock in medical devices is to provide for redundant grounding of the medical device. This method of reducing electrical shock hazards is discussed in Martucci, U.S. Pat. No. 4,025,139. Martucci discloses several configurations of power cords, plugs, and receptacles for providing redundant grounding of electrical devices. The devices disclosed in Martucci require replacement or modification of standard duplex receptacles typically present in a health care facilities.

Health care facilities would welcome an electrical cord and plug which provides for redundant grounding of medical devices and which could be used without replacement of, or modification of, hospital grade duplex receptacles currently present in health care facilities.

A power cord and plug in accordance with the present invention for use with a standard grounded duplex receptacle having two three-contact sockets includes a plug housing having a power prong, a neutral prong, a first ground prong, and a second ground prong, and four separate conductors connected at one end to one of each of the power prong, neutral prong, first ground prong, and second ground prong. The power prong, neutral prong, and first ground prong are arranged to be received in the power contact, neutral contact, and ground contact of one of the two sockets present in the duplex receptacle while the second ground prong is received in the ground contact of second socket present in the duplex receptacle. A flexible boot extends from the plug housing and is configured to form a seal around the power prong, neutral prong, first ground prong, and second ground prong when the prongs are properly received in the duplex receptacle.

Features and advantages of the invention will become apparent to those skilled in the art upon consideration of the following detailed description of an illustrated embodiment exemplifying the best mode of carrying out the invention as presently perceived.

DETAILED DESCRIPTION OF THE DRAWINGS

The medical equipment cord and plug of the present invention includes four electrical conductors each connected at one end to one of four prongs in a plug housing. The prongs are configured for receipt in all three contacts of one of the two sockets of a duplex receptacle and the ground contact of the other socket of the duplex receptacle. The cord and plug provide a redundant ground path, at least as far as the receptacle, so that failure of one of the ground paths alone will not result in improper grounding of the medical device. The medical cord and plug also includes a flexible rubber boot that engages the face plate covering of an electrical box containing the receptacle to inhibit moisture from contacting the prongs or entering the receptacle to cause a ground fault.

Figure 1:
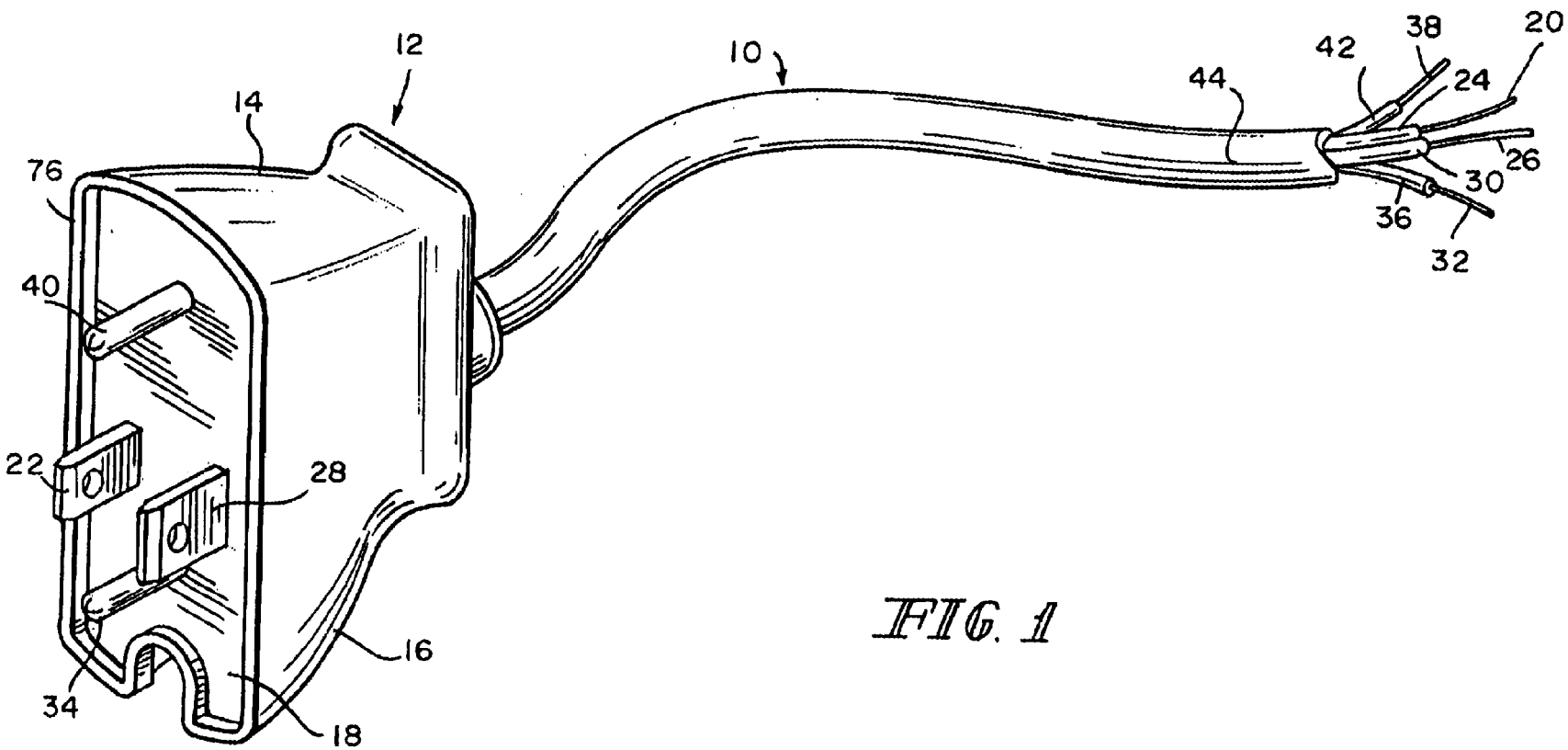
FIG. 1 is a perspective view of a power cord and plug for use with medical equipment showing a shorter power blade, a taller neutral blade, and two grounding prongs extending from a housing connected to a cord having four wires, two of which are redundant grounding wires.

Referring now particularly to FIG. 1, there is shown an electrical cable 10 and plug 12. Electrical cable 10 includes four conductive elements 20, 26, 32, 38 each of which is individually enclosed in insulative material 24, 30, 36, 42 and all of which are enclosed in a common insulative material 44. Plug 12 includes live prong 22 which is blade shaped, neutral prong 28 which is blade shaped and which may be slightly larger than the blade of live prong 22 for polarized applications, first ground prong 34 which has a U-shaped cross section (FIG. 3), and second ground prong 40 which also has a U-shaped cross section. Since cable 10 includes four mutually insulated conductive elements 20, 26, 32,38 and plug 12 includes four spaced apart prongs 22, 28, 34, 40, there are sufficient current paths to provide a power circuit through the live prong 22, live wire 20, neutral prong 28, and neutral wire 26 and two separate ground paths. Thus plug 12 and cable 10 supply a medical device with the power necessary for operation while providing redundant paths between the medical device and ground.

Electrical conductor 20, or live wire, is connected at a first end to power blade 22 and at the opposite end to a terminal in a medical device assigned to receive a time varying current. Insulative material 24 surrounding live wire 20 is color coded in accordance with the American standard color coding for electrical conductors, i.e. insulating material 24 is black because it is associated with a live wire 20.

Insulative material 24, 30, 36, 42, 44 are illustratively rubber, PCV, or other insulative material approved for use in a hospital environment. Electrical conductors 20, 26, 32, 38 are illustratively No. 16 gauge AWG copper wire with 65×34 stranding in order to meet Underwriters Laboratory requirements for hospital grade electrical cords.

Electrical conductor 26, or neutral wire, is connected at one end to neutral blade 28 and is connected at the other end to a terminal of a medical device which is configured to remain neutral. In accordance with the American standards for color coding for electrical conductors, insulative material 30 is white as it is associated with neutral wire 26.

Electrical conductor 32, or first ground wire, is connected at first end to first ground prong 34 and at the other end to one of two ground terminals in the medical device. In accordance with the American standards for color coding of electrical conductors, insulative material 36 is green as it is associated with a ground wire 32.

Electrical conductor 38, or second ground wire, is connected at one end to second ground prong 40 and at the opposite end to a second ground terminal of the medical device. In accordance with the American standard for color coding of electrical conductors, insulative coating 42 is green with a yellow stripe as it associated with second ground wire 38.

Live wire 20, neutral wire 26, first ground wire 32, and second ground wire 38 are enclosed in insulative material or jacket 44 shown illustratively as PVC having 0.005" wall thickness. It should be understood that insulative jacket 44 may be formed of any insulative material which is acceptable for use in a hospital environment. It should also be understood that electric cable 10 may be formed from four conductive elements 20, 26, 32, 36 with each conductive element being received in one of four non-communicating lumens of a quadruple-lumen sheath of insulating material or in some other acceptable manner which provides four conductive elements mutually insulated from each other.

Figure 4:
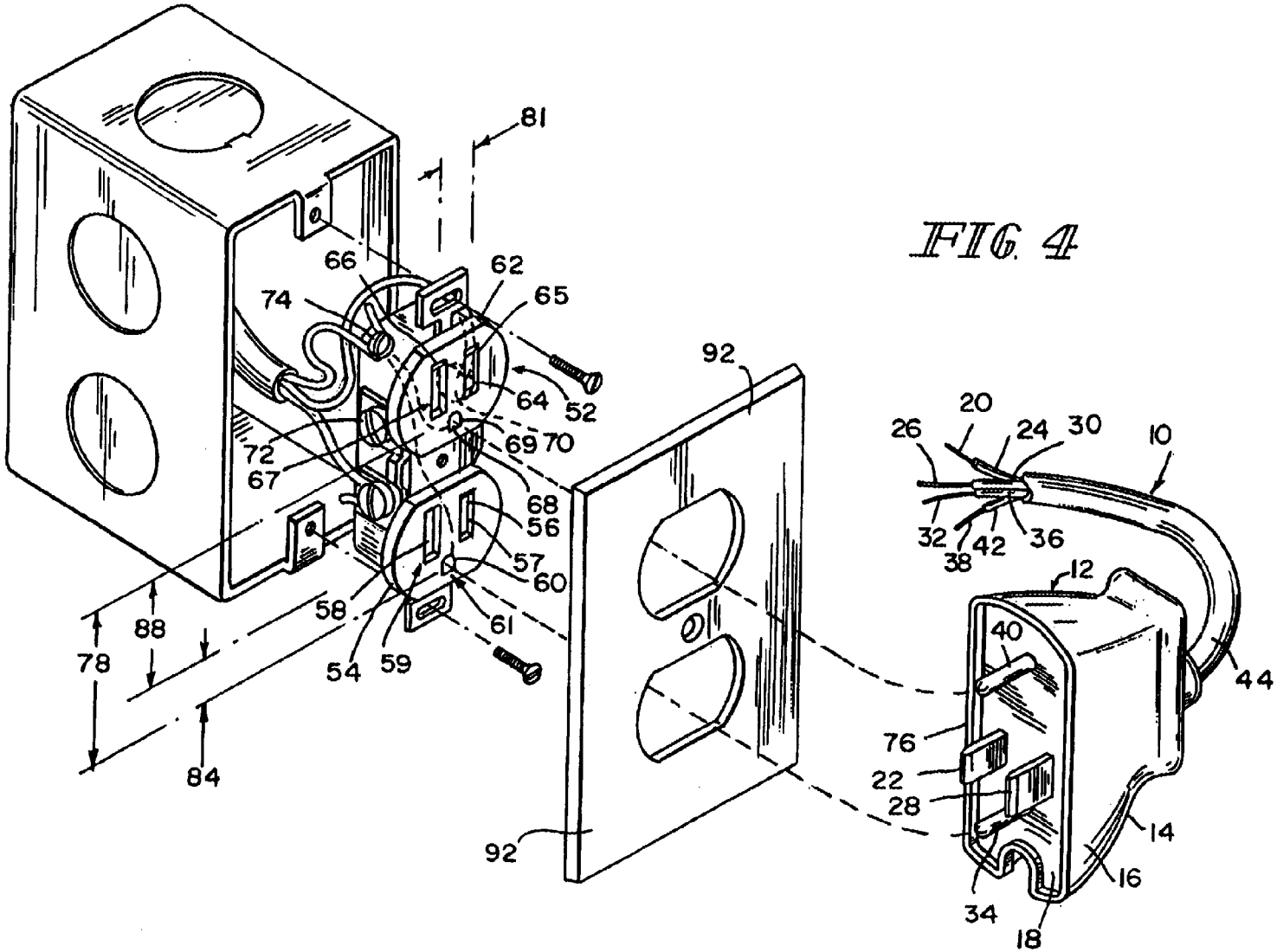
FIG. 4 is a perspective view of the cord and plug of FIG. 1 in proximity to a standard hospital grade duplex receptacle indicating that the power blade, neutral blade, and first grounding prong of the plug are configured to be received in one of the two sockets present in the duplex receptacle while the second grounding prong is configured to be received in the ground opening of the second socket.
Figure 5:
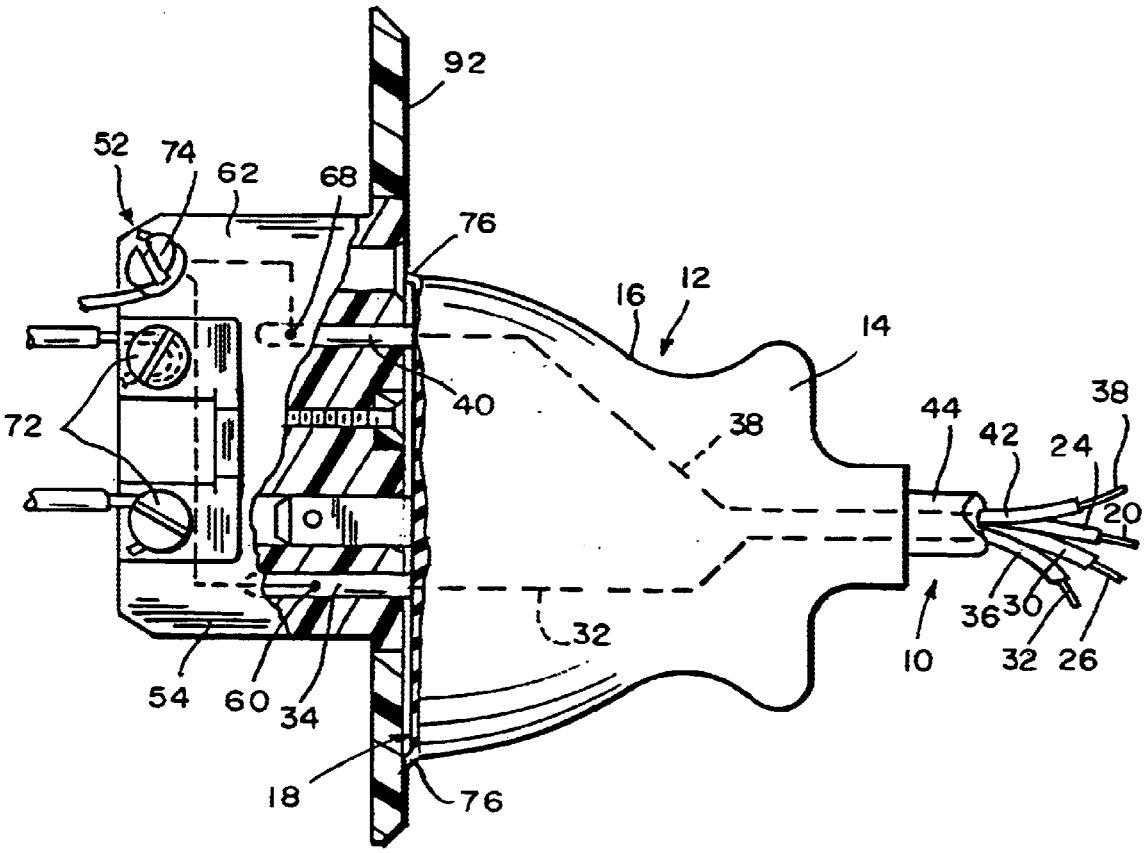
FIG. 5 is a partial cross sectional view of the cord and plug of the present invention received in a standard duplex receptacle showing a receptacle-engaging boot extending from the plug housing to form a seal surrounding the blades and prongs of the plug to inhibit fluids from contacting the blades and prongs and causing an electrical fault.

Plug 12 is configured for use with a standard duplex receptacle 52 having a first socket 54 and a second socket 62. Referring to FIGS. 4 and 5, a duplex receptacle 52 having a standard configuration commonly found in health care facilities in the United States and some other countries is illustrated. First socket 54 includes a live contact 56 adjacent to a live slot 57, a neutral contact 58 adjacent to a neutral slot 59, and a ground contact 60 adjacent to a ground opening 61. Second socket 62 includes a live contact 64 adjacent to a live slot 65, a neutral contact 66 adjacent to a neutral slot 67, and a ground contact 68 adjacent to a ground opening 69. Standard hospital grade duplex receptacle 52 includes live terminals 70 electrically connected to live contacts 56, 64, (connection not shown) neutral terminals 72 electrically connected to neutral contacts 58, 66, (connection not shown) and at least one ground terminal 74 electrically connected to ground contacts 60, 68 (shown by dotted lines in FIG. 5).

A live wire is typically connected at one end to the live terminal 70 and at the other end to the hot bus of the health care facility's power supply, a neutral wire is typically connected at one end to the neutral terminal 72 and at the other end to the neutral bus of the health care facility's power supply, and a ground wire is typically connected at one end to the ground terminal 74 and at the other end to the ground bus of the health care facility's power supply. Duplex receptacle therefore includes two separate openings 61, 69 adjacent to two contacts 60, 68 which provide a path to ground and is thus adapted for use with a plug 12 and cord 10 providing redundant grounding.

Plug 12 has a housing 14 including a side wall 16, a receptacle-facing surface 18, and a flexible boot 76 extending from the side wall 16 beyond receptacle-facing surface 18. Power blade 22, neutral blade 28, first ground prong 34, and second ground prong 40 extend substantially perpendicularly from receptacle-facing surface 18. As shown for example, in FIG. 3, receptacle-facing surface 18 has a longitudinal axis 46 and a lateral axis 48.

Figures 2, 3:
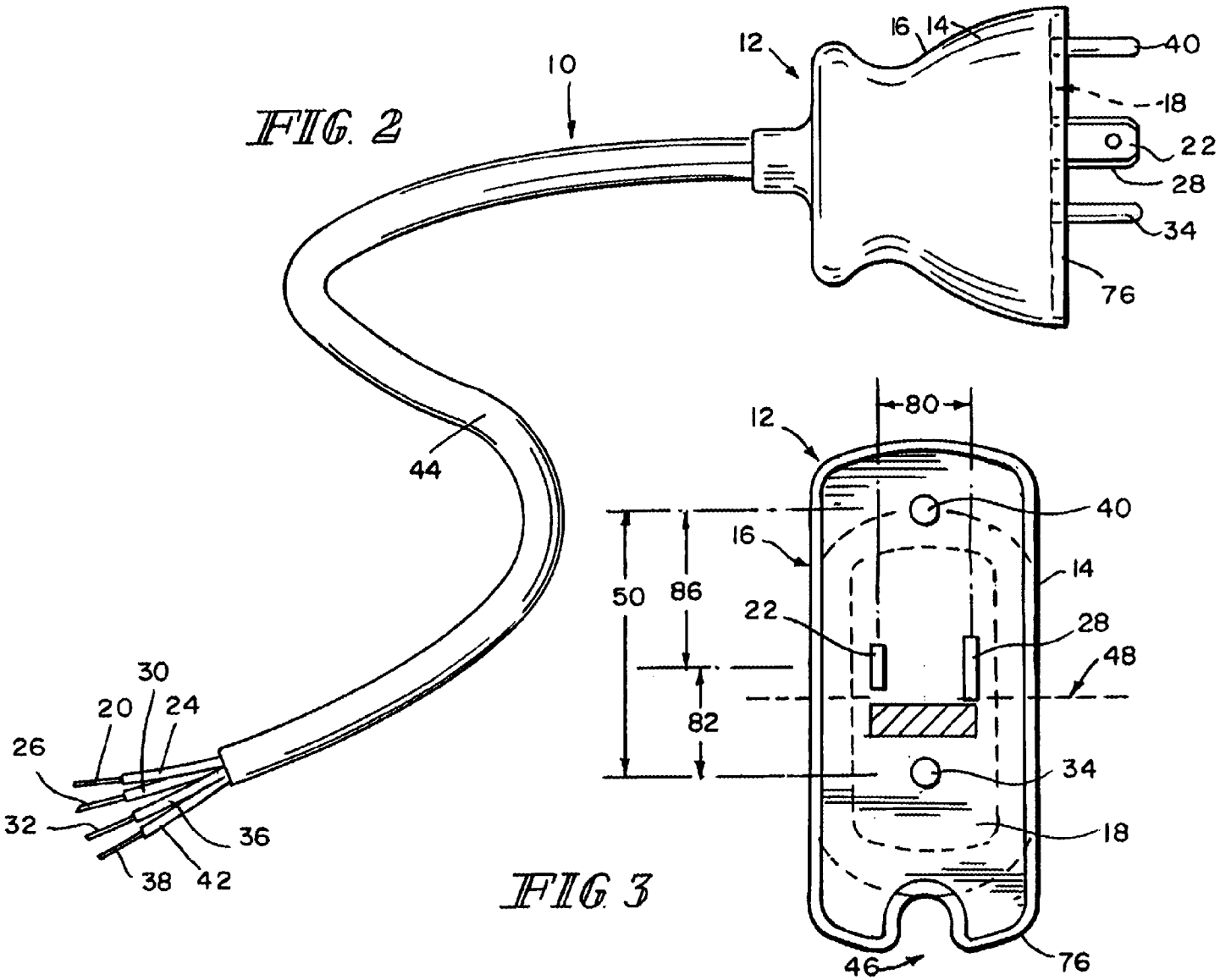
FIG. 2 is a side elevation view of the cord and plug of FIG. 1.
FIG. 3 is a front elevation view of the cord of FIG. 1.

Referring now particularly to FIGS. 3–5, the configuration of the prongs 22, 28, 34, 40 in plug 12 and openings 57, 59, 61, 65, 67, 69 in receptacle 52 is illustrated. First ground prong 34 and second ground prong 40 have a substantially U-shaped cross section and are configured to extend through receptacle-facing surface 18 on longitudinal axis 46. First ground prong 34 and second ground prong 40 are spaced apart by a displacement 50 of approximately 1.532" on center. Displacement 50 coincides precisely with displacement 78 between ground openings 61, 69 adjacent to the grounding contacts 60, 68 of the first socket 54 and second socket 62 of a standard duplex receptacle 52 facilitating simultaneous reception of first ground prong 34 into first ground opening 61 and second ground prong 40 into second ground opening 69.

Power blade 22 and neutral blade 28 are spaced apart by a lateral displacement 80 of ½" and are symmetrically placed about longitudinal axis 46 and displaced therefrom by ¼". Therefore, power blade 22 and neutral blade 28 are each displaced by ¼" laterally from each grounding prong 34, 40. Lateral displacement 80 of power blade and neutral blade coincides precisely with the displacement 81 between live slot 57 and neutral slot 59 of duplex receptacle 52.

Neutral blade 28 and power blade 22 are displaced longitudinally on center from first ground prong 34 by a displacement 82 which coincides with the longitudinal on center displacement 84 of first live slot 57 and first neutral slot 59 from first ground slot 61. Neutral blade 28 and power blade 22 have an on-center longitudinal displacement 86 from second ground prong 40 which coincides precisely with the on-center displacement 88 of first live slot 57 and first neutral slot 59 from second ground opening 69. Thus, plug 12 is designed and arranged so that power blade 22 may be received in live slot 57 adjacent to the live contact 56 of the first socket 54, neutral blade 28 may be received in neutral slot 59 adjacent to the neutral contact 58 of first socket 54, first ground prong 34 may be received in ground opening 61 adjacent to the ground contact 60 of the first socket 54 and second ground prong 40 may be received in ground opening 69 adjacent to the ground contact 68 of second socket 62 simultaneously of a duplex receptacle 52, as shown, for example, in FIGS. 4 and 5.

As shown, for example, in FIG. 2, first ground prong 34 and second ground prong 40 extend farther from receptacle-facing surface 18 than power blade 22 and neutral blade 28. This configuration is to allow the ground prongs 34, 40 to engage ground contacts 60, 68 of duplex receptacle 52 before power blade 22 and neutral blade 28 engage live contact 56 and neutral contact 58. Thus, during insertion of plug 12 into duplex receptacle 52, the ground circuit is made before the power circuit is made ensuring that the medical device to which power cord 10 and plug 12 are attached is properly grounded prior to receiving current. Likewise, when plug 12 is removed from duplex receptacle 52, the power circuit is broken before the grounding circuits are broken so that the medical device to which cord 10 and plug 12 are attached is grounded even after the power circuit is broken.

As shown, for example, in FIG. 2, receptacle-engaging flexible boot 76 extends substantially perpendicularly beyond receptacle-facing surface 18 from side wall 16 of plug housing 14. Boot 76 extends approximately 0.06" from receptacle-facing surface 18 when not subjected to any distortion or compression forces. When the prongs 34, 40 and blades 22, 28 of plug 12 are fully received within duplex receptacle 52, as shown, for example, in FIG. 5, boot 76 engages the receptacle cover 92 and is slightly compressed and distorted to form a seal surrounding the slots 57, 59 and openings 61, 69 of receptacle 52 and blades 22, 28 and prongs 34, 40 of plug 12. This aids in preventing fluid from contacting the blades 22, 28 and prongs 24, 40 of plug 12 or entering the slots 57, 59 or openings 61, 69 of receptacle 52 and thereby causing an electrical fault.

The illustrated embodiment of the invention shows a cable 10 and plug 12 configured to provide redundant grounding when used with an unmodified standard duplex outlet 52 with a lower socket 54 and an upper socket 62 each providing a circuit supplying a 120 volt potential difference for generating a current and a dedicated path to ground as is commonly available in the United States; nevertheless, it should be understood that the invention is not limited to the illustrated configuration. The illustrated embodiment disposes the live prong 22 and neutral prong 28 between the first and second ground prongs 34, 40 so that power is supplied by the lower socket 54 and redundant grounding is achieved by mating the first ground prong 34 with the ground contact 60 of lower socket 54 and mating second ground prong 40 with ground contact 68 of upper socket 62.

One alternative configuration of the plug places both ground prongs on the same side of the live and neutral prongs so that power and the first ground path are provided by mating the live, neutral, and first ground prong with hot 64, neutral 66, and ground 68 contacts of upper socket 62 respectively and the redundant ground path is provided by mating the second ground prong with ground contact 60 of lower socket 54. This first alternative configuration of the plug could be used in the United States, and other countries using the same standard duplex receptacles as the United States, to provide redundant grounding of a medical device without replacement or modification of the standard duplex receptacle 52.

In other countries, standard duplex receptacles at electrical outlets supply different voltages through hot and neutral contacts and are configured differently. When it is envisioned that a medical device will be used in countries which have standard duplex receptacles with each socket providing a ground contact and hot and neutral supply contacts, alternative embodiments of the plug can be appropriately configured to mate with that countries standard receptacle. These alternative embodiment plugs are configured so that power is supplied to the device through mating of properly configured live and neutral prongs in the plug with the hot and neutral contacts in one socket, one ground path is provided by mating a properly configured first ground prong with the ground contact of the first socket, and a redundant ground path is provided by mating a properly configured second ground prong with the ground contact of the second socket. All alternative plugs for use in countries having alternative configurations of duplex outlets are configured so that redundant grounding can be provided to the medical equipment without replacing or modifying that countries standard receptacle.

It is a common practice to provide multiple supplies of power through standard multi-socket receptacles, such as power strips or the like. Additional alternative plugs in accordance with the present invention are configured to provide power to devices supplied by such multi-socket receptacles. These alternative plug embodiments are configured to provide power by mating of properly configured live and neutral prongs in the plug with the hot and neutral contacts in one socket, one ground path is provided by mating a properly configured first ground prong with the ground contact of the same socket, and a redundant ground path is provided by mating a properly configured second ground prong with the ground contact of one of the other sockets, preferably an adjacent socket. These alternative plugs are configured so that redundant grounding can be provided to a medical device without replacement or modification of the multi-socket receptacle.

Although the invention has been described in detail with reference to a certain illustrated embodiment and alternative non-illustrated embodiments, variations and modifications within the scope and spirit of the invention as described and defined in the following claims.

What is claimed is:

1. A power cord and plug for connection to a standard grounded duplex wall receptacle having a first socket including a first live contact, a first neutral contact, and a first ground contact and a second socket including a second live contact, a second neutral contact and a second ground contact, the power cord and plug comprising:

a cable having a live conductor, a neutral conductor, a first ground conductor, and a second ground conductor, and a plug having a housing and a set of prongs consisting of only four prongs, a first prong of the four prongs being a live prong configured to be received by the first live contact and electrically connected to the live conductor, a second prong of the four prongs being a neutral prong configured to be received by the first neutral contact and electrically connected to the neutral conductor, a third prong of the four prongs being a first ground prong configured to be received by the first ground contact and electrically connected to the first ground conductor, and a fourth prong of the four prongs being a second ground prong configured to be received by the second ground contact and electrically connected to the second ground conductor, wherein the live prong, neutral prong, first ground prong, and second ground prong extend from the housing in fixed relation to one another, wherein the live prong, neutral prong, first ground prong, and second ground prong are configured for concurrent reception by the first live contact, first neutral contact, first ground contact, and second ground contact, respectively, of the standard grounded duplex wall receptacle, wherein the plug is configured to prevent a three-prone power connector from being plugged to the standard grounded duplex wall receptacle when the plug is plugged to the standard grounded duplex wall receptacle.

2. The apparatus of claim 1 wherein the housing has a receptacle-facing surface and a receptacle-engaging flexible boot extending from the receptacle-facing surface, and the live prong, neutral prong, first ground prong, and second ground prong extend through the receptacle-facing surface and the receptacle-engaging boot surrounds the live prong, neutral prong, first ground prong, and second ground prong.

3. The apparatus of claim 2 wherein the flexible boot inhibits fluids from engaging the live prong when the live prong is received in the receptacle.

4. The apparatus of claim 1 wherein the first and second ground prong have a generally U-shaped cross-section.

5. The apparatus of claim 4 wherein the live prong and neutral prong are blades.

6. The apparatus of claim 5 wherein the live prong and neutral prong are disposed between the first ground prong and the second ground prong.

7. The apparatus of claim 6 wherein the housing has a receptacle-facing surface and the first and second ground prongs extend farther from the receptacle-facing surface than the live prong and neutral prong.

8. A power connection providing a redundant path to ground for an electrical device comprising:

a standard wall receptacle having a plurality of sockets each of said sockets having a live contact, a neutral contact, and a ground contact, a plug having a housing and an electrical interface consisting of a live contact, a neutral contact, a first ground contact, and a second ground contact, wherein the live contact, neutral contact, first ground contact, and second ground contact extend from the housing in fixed relation to one another, wherein the live contact of the plug is configured to mate with the live contact of a selected socket of the plurality of sockets of the standard wall receptacle, the neutral contact of the plug is configured to mate with the neutral contact of the selected socket, the first ground contact of the plug is configured to mate with the ground contact of the selected socket and the second ground contact of the plug is configured to mate with the ground contact of a second selected socket of the plurality of sockets of the standard wall receptacle, and a cable including a live conductor electrically connected to the live contact of the plug, a neutral conductor electrically connected to the neutral contact of the plug, a first ground conductor electrically connected to the first around contact of the plug and a second ground conductor electrically connected to the second ground contact of the plug.

9. The apparatus of claim 8 wherein the cable includes insulative material insulating the live conductor, neutral conductor, first ground conductor, and second ground conductor from each other.

10. The apparatus of claim 9 wherein the second selected socket is adjacent to the selected socket.

11. The apparatus of claim 8 wherein the live contact in the plug is a male contact and the live contact in each of the plurality of sockets is a female contact.

12. The apparatus of claim 11 wherein the neutral contact in the plug is a male contact and the neutral contact in each of the plurality of sockets is a female contact.

13. The apparatus of claim 12 wherein the second selected socket is adjacent to the selected socket.

14. The apparatus of claim 13 wherein the live contact and neutral contact of the plug are disposed between the first ground contact and the second ground contact of the plug.

15. The apparatus of claim 14 wherein the plug includes a receptacle-facing surface and the first and second ground contacts extend farther from the receptacle-facing surface than the live contact and neutral contact.

16. A power cord and plug for connection to a standard grounded duplex wall receptacle having a first socket having an electrical interface consisting of a first live contact, a first neutral contact, and a first ground contact and a second socket consisting of a second live contact, a second neutral contact and a second ground contact, the power cord and plug comprising:

a cable having a live conductor, a neutral conductor, a first ground conductor, and a second ground conductor, a plug having a housing and an electrical interface, the electrical interface consisting of only four prongs, a first prong of the four prongs being a live prong configured to be received by the first live contact and electrically connected to the live conductor, a second prong of the four prongs being a neutral prong configured to be received by the first neutral contact and electrically connected to the neutral conductor, a third prong of the four prongs being a first ground prong configured to be received by the first ground contact and electrically connected to the first ground conductor, and a fourth prong of the four prongs being a second ground prong configured to be received by the second ground contact and electrically connected to the second ground conductor, wherein the live prong, neutral prong, first ground prong, and second ground prong extend from the housing so as to be positioned in fixed relation to one another, wherein the live prong, neutral prong, first ground prong, and second ground prong are configured for concurrent reception by the first live contact, first neutral contact, first ground contact, and second ground contact, respectively, of the standard grounded duplex wall receptacle, wherein the plug is configured to prevent a three-prong power connector from being plugged to the standard grounded duplex wall receptacle when the plug is plugged to the standard grounded duplex wall receptacle.

* * * * *